United States Patent [19]

Talafuse

[11] 4,405,014

[45] Sep. 20, 1983

[54] SAFETY VALVE MANIFOLD SYSTEM

[75] Inventor: Larry J. Talafuse, Spring, Tex.

[73] Assignee: FMC Corporation, Chicago, Ill.

[21] Appl. No.: 353,111

[22] Filed: Feb. 26, 1982

Related U.S. Application Data

[63] Continuation of Ser. No. 139,502, Apr. 11, 1980, abandoned.

[51] Int. Cl.[3] ..... E21B 7/12

[52] U.S. Cl. ..... 166/72; 166/95; 166/97; 251/57

[58] Field of Search ..... 166/72, 95, 97, 321, 166/375; 251/29, 28, 59, 57

[56] References Cited

U.S. PATENT DOCUMENTS

| | | | |
|---|---|---|---|
| 2,998,070 | 8/1961 | Tamplen | 166/72 |
| 3,142,337 | 7/1964 | Poorman . | |
| 3,467,129 | 9/1969 | Gratzmuller | 251/57 |
| 3,763,891 | 10/1973 | Stiltner | 137/625.18 |
| 3,850,237 | 11/1974 | Ahlstone | 166/72 |
| 3,854,695 | 12/1974 | Baugh | 251/129 |
| 4,082,147 | 4/1978 | Wolff | 166/314 |
| 4,193,449 | 3/1980 | Lochte | 166/72 |
| 4,258,786 | 3/1981 | Lochte | 166/72 |

*Primary Examiner*—William F. Pate, III

*Attorney, Agent, or Firm*—W. William Ritt, Jr.; Richard B. Megley

[57] ABSTRACT

A hydraulic safety valve manifold system for providing positive opening and closing of a surface-controlled, sub-surface safety valve in a subsea well, including a shut-off valve which prevents leakage of well fluids to the outside environment if a leak should occur in the safety valve or in hydraulic lines which are connected to the hydraulic actuator of the safety valve. A hydraulic control line is connected to the safety valve actuator through a normally closed shut-off valve, and this line is also connected to the actuator of the shut-off valve to hold both the shut-off valve and the safety valve open when the line is pressurized. The hydraulic line is also connected to an actuator of a variable volume accumulator to empty the accumulator when the line is pressurized. When pressure in the hydraulic line is relieved the shut-off valve closes and the accumulator accepts fluid from the hydraulic actuator of the safety valve to insure that the safety valve closes.

14 Claims, 5 Drawing Figures

SAFETY VALVE MANIFOLD SYSTEM

This application is a continuation of application Ser. No. 139,502, filed Apr. 11, 1980, now abandoned.

BACKGROUND OF THE INVENTION

1. Field of the Invention

This invention relates to hydraulic valve control circuits, and more particularly to valve operating circuits for providing positive opening and closing of surface-controlled, sub-surface safety valves while preventing leakage of fuel to the outside environment.

2. Description of the Prior Art

Crude oil and gas wells are often drilled and tubing is installed at locations where the internal pressure of the petroleum deposit is quite high so that precautions must be taken to prevent a blowout of the well. Such blowouts are not only costly in terms of loss of oil or gas but in addition a blowout is highly dangerous and the cost of controlling a blowout at an oil or gas well is rather high. As a result, many devices including safety valves and associated control circuits have been developed and many such devices have been installed in association with gas and oil wells. One such device that is frequently employed is a surface-controlled, sub-surface safety valve (SCSSV) which can be installed within the tubing of a well either prior to running the tubing into the well, or afterward by means of well-known wire line techniques. Such valves are generally positioned 200 or 300 feet below the wellhead, and are always of the "fail-close" design. The construction of these valves resembles a conventional ball valve wherein positive actuation against a spring is required to open it, for example by applying hydraulic pressure to a small diameter control line and to a valve actuator which can be conveniently located within the well. In some of the installations the valve actuator can be positioned outside the tubing.

The hydraulic pressure applied to the control line must be sufficient to develop a force on one face of the piston of the actuator greater than the combination of the opposing force developed by gas or oil pressure in the tubing acting on the opposite face of the piston and the spring-generated valve closing force. Because of the depth of the safety valves, there is a substantial fluid head in the control line which provides a significant amount of pressure acting on the piston of the actuator, so that the spring force, the valve depth, and the location of the safety valve must be carefully selected to ensure complete closure of the valve when the pressure in the control line is relieved by action taken at the surface.

Another type of SCSSV hydraulic circuit in common use involves a hydraulic balance and requires both a hydraulic control line to open and close the valve and a balance line which communicates with the opposing face of the piston of the actuator. By means of this arrangement, the control line pressure needs only to overcome the spring force since otherwise the forces are equal but opposite as developed by the head in both the control line and in the balance line.

Whether a balanced type SCSSV or a non-balanced type is used, it is common practice to pass the control and/or balance lines through the wellhead and its connector and then exit the christmas tree below the master valve. The control and/or balance lines, after leaving the christmas tree, are connected to a control system to enable operation of the SCSSV.

The previously proposed control systems have the disadvantage that if a leak or other malfunction occurs in the SCSSV, which results in connecting the tubing bore to the control line, a high pressure leakage path is then formed to the outside environment. Such a leak can damage the control system and also allow oil or gas to pollute the environment. This problem has already been appreciated and with a view to solving it, shut-off valves have been provided where the control and/or balance lines leave the christmas tree. By this provision, if a leak should occur, the shut-off valves can be closed manually but further problems arise if the christmas tree is installed below the surface of the sea because the shut-off valves will then require actuators, for example, hydraulic actuators so that the shut-off valves can be remotely opened or closed.

It will be apparent that the shut-off valves in the control and/or balance lines must be open when it is desired to open the associated SCSSV so that fluid can be forced under pressure to the actuating cylinder of the SCSSV. Even more important, the shut-off valves must remain open until the SCSSV has completely closed. Once the latter has closed it is desirable to close fully the shut-off valves. However, if the shut-off valves are allowed to close before the SCSSV has completely closed, the shut-off valves will not allow fluid to flow away from the actuator of the SCSSV, and therefore the latter will remain open or partially open. It follows that for fully safe operation there must be proper cooperation between the actuator of the SCSSV and the shut-off valves particularly for remote or sub-sea surface locations. In order more fully to take into account the difficulties outlined above, control systems such as hydraulic sequencing or electrohydraulic multiplexing systems have been proposed so that the shut-off valves are connected to separate hydraulic output lines of the control system and are actuated independently of the SCSSV control line. These proposed control systems are generally satisfactory but do not provide for the sudden loss of hydraulic pressure in the control system. Such loss in hydraulic pressure will result in the well becoming shut down because all the valves from the christmas tree including the SCSSV will close because of their "fail-close" characteristics. However, the loss of hydraulic pressure will provide no assurance that the shut-off valves will remain open long enough to allow complete closure of the associated SCSSV.

As an alternative to the complexities of hydraulic sequencing or electro-hydraulic multiplexing, a simple hydraulic time delay circuit has been proposed which comprises simply a restrictor valve and an accumulator which ensures that the SCSSV closes before the shut-off valve is timed to close. This system has the merit of simplicity but does not provide a complete answer to the problems involved. In particular it is neither possible readily to know the exact closing time of the SCSSV after installation nor is it possible to ensure that it will remain constant over long periods of time. To ensure that the system is basically safe, it has been proposed simply to make the time constant long enough to accommodate the longest possible closing times for the SCSSV. However, such long time constants require either very small orifice restrictor valves which are liable to clog or large accumulators which cannot readily be accommodated in the limited space available.

Another hydraulic valve operating circuit, disclosed in U.S. Pat. No. 4,193,449 issued to Lochte et al, includes a plurality of shut-off valves mounted in the wall of a well and connected to provide positive opening and closing of a SCSSV while isolating the safety valve from the outside environment. The shut-off valves prevent leakage of well fluids to the outside environment if a leak should occur between the inside of the well and the hydraulic lines which are connected to the safety valve actuator. The shut-off valves also insure that the safety valve will close properly by relieving the fluid pressure applied to the safety valve actuator when it is desired to close the safety valve.

SUMMARY OF THE INVENTION

The present invention uses a single shut-off valve mounted in the wall of a well to connect a surface-controlled, sub-surface safety valve to an outside hydraulic pressure source and to a pressure sink while isolating the safety valve from the outside environment, and to provide positive opening and closing of the surface-controlled, sub-surface safety valve. The single shut-off valve prevents leakage of well fluids to the outside environment if a leak should occur between the inside of the well and the hydraulic lines which are connected to the valve actuator. The shut-off valve also insures that the safety valves will close properly by relieving the fluid pressure applied to the safety valve actuator when it is desired to close the safety valve.

The present invention provides a control system for a fail-close surface-controlled, sub-surface safety valve comprising an actuator for the safety valve, a shut-off valve in the circuit connected to the safety valve, and means responsive to a drop in pressure in the control system below a predetermined value to relieve pressure in the actuator of the safety valve and thus allow the safety valve and the shut-off valve to close.

According to the present invention there is provided a surface-controlled, sub-surface fail-close safety valve, an actuator positively operable to open the safety valve, and a control line communicating with the safety valve actuator through a normally closed shut-off valve and through a fluid accumulator to hold the valves open when the control line is pressurized. A reduction in pressure on the control line allows fluid from the safety valve actuator to be directed into the accumulator, whereby the safety valve is free to close by virtue of its fail-close characteristics.

DESCRIPTION OF THE PREFERRED EMBODIMENT

Figure 1:
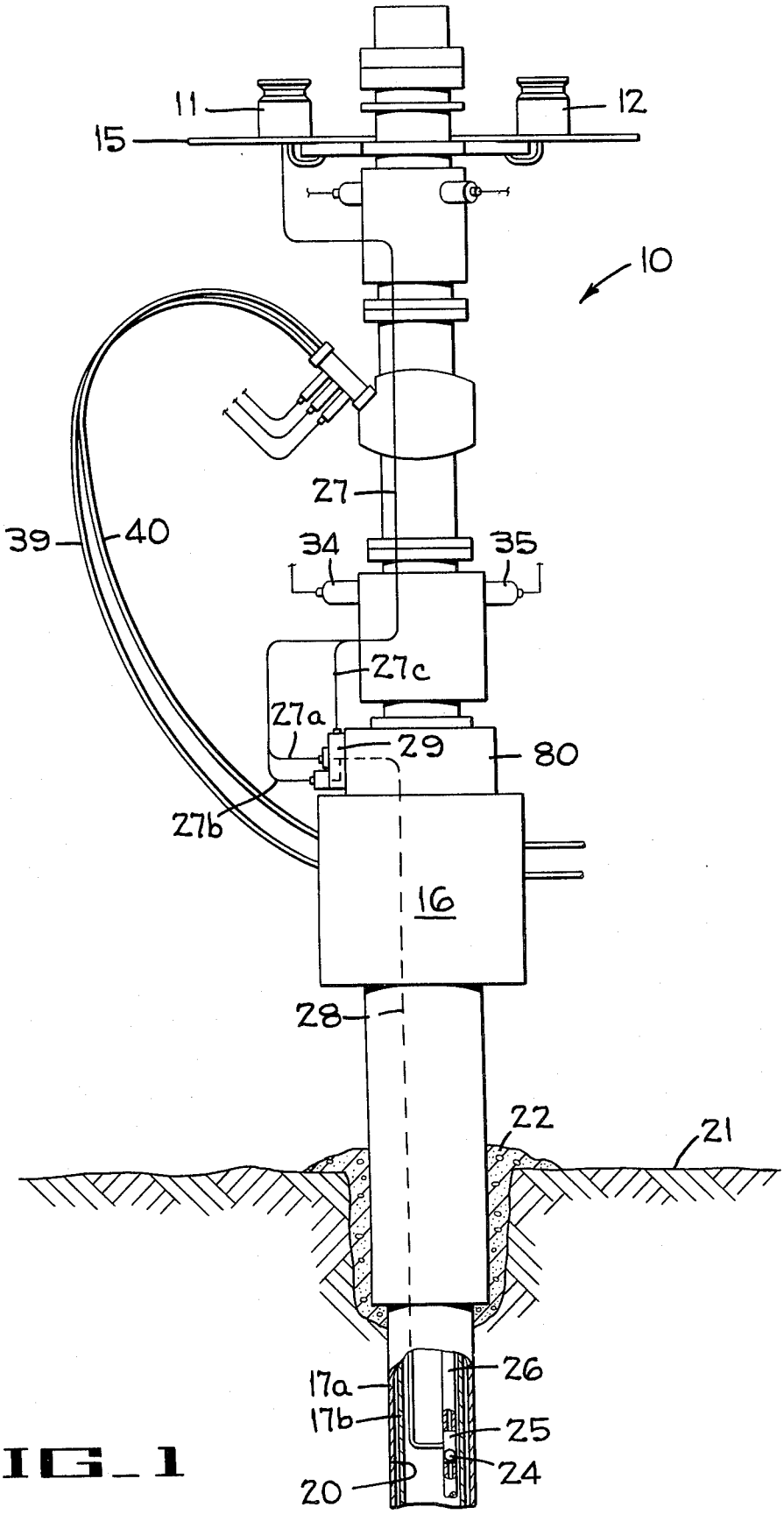
FIG. 1 is a diagrammatic side elevation of a subsea well in which the present invention may be used, with portions being broken away.

Referring now to the drawings, FIG. 1 illustrates a petroleum well, of the type that is used to produce oil and gas, completed with a christmas tree 10 and a pair of control modules 11,12 mounted on a mounting plate 15. The christmas tree 10 is mounted atop the well by a tree connector 16 and a plurality of casing strings **17*a*,17*b* are suspended in a bore hole 20 drilled into the sea floor 21. The casing strings 17*a*,17*b* are anchored in position by cement 22 which is pumped into the annulus between the bore hole 20** and the outermost string of casing.

A surface-controlled, sub-surface safety valve 24 and a safety valve actuator 25 are positioned inside the inner string **17*b* several feet below the christmas tree 10 to provide positive control of fluid through a tubing string 26. The safety valve actuator 25 is coupled to a hydraulic fluid source P and to a sink S (FIGS. 3–5) by hydraulic lines 27,28, by a shut-off or gate valve 29 located in the wall of the christmas tree 10, and by a three-way valve 30. The source of pressure P, the sink S and the three-way valve 30 are located at a control center 33 at the ocean surface. A pair of valve operators 34,35 (FIG. 1) control the operation of a pair of christmas tree valves (not shown) inside the tree to control a flow of oil from the tree through a pair of tree flow lines 39,40. Each of the flow lines 39,40 is in the form of a loop having sufficient radius to facilitate passage of conventional "through-flow-loop" tools (not shown) therethrough. Operation of the valve operators 34,35 is controlled by the control modules 11,12**.

A circuit which provides control of the SCSSV 24 (FIGS. 3–5) includes the safety valve actuator 25 having an annular body 41 with a piston 45 mounted therein. The piston 45 is biased toward the upper end of the actuator by a spring 46 which closes the valve when the piston is adjacent the upper end of the body 41. The hydraulic control line 28 provides hydraulic fluid under pressure to move the piston 45 downward, thereby opening the surface-controlled, sub-surface safety valve 24.

Figure 2:
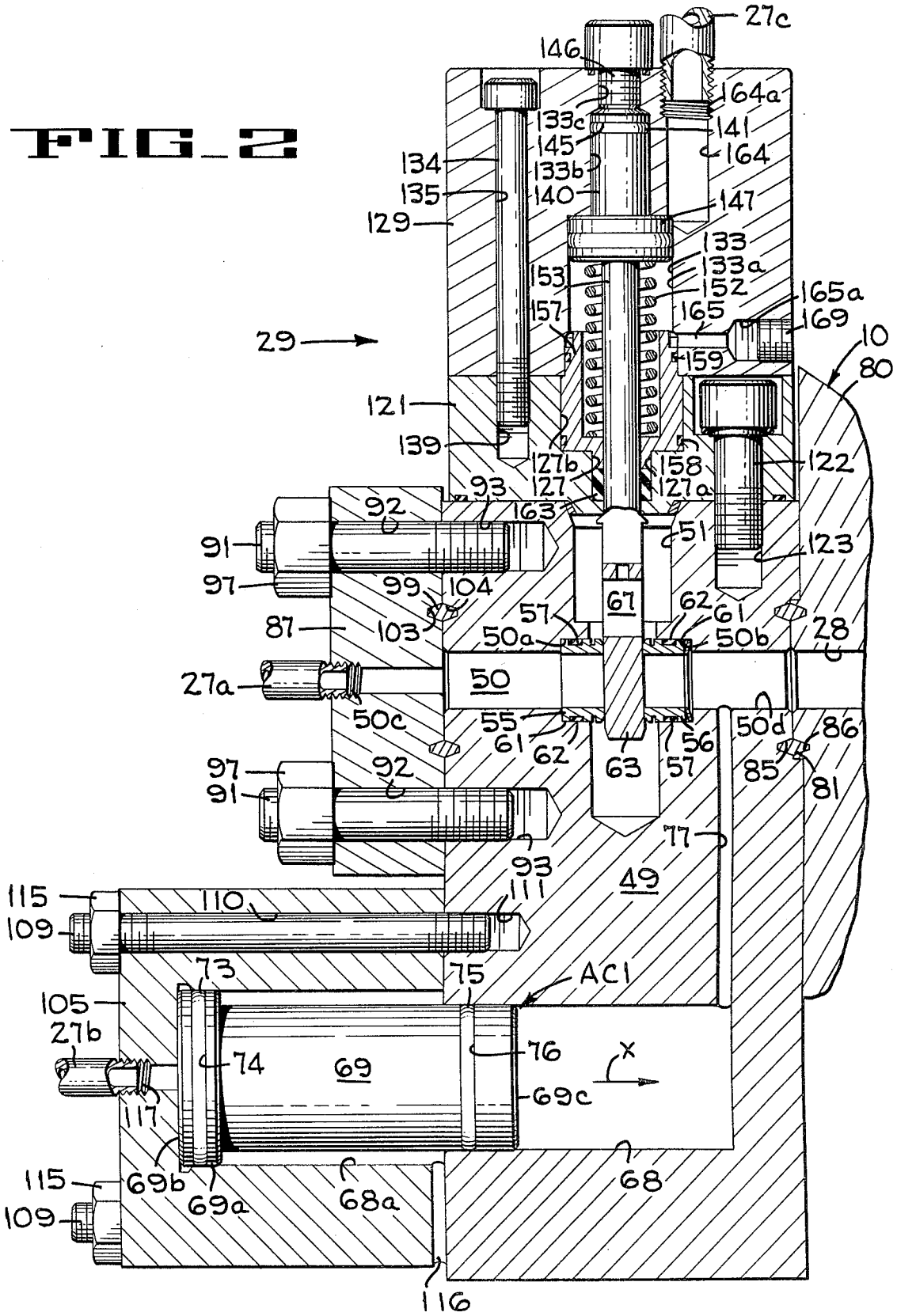
FIG. 2 is a vertical section of a shut-off valve used in the present invention.
Figure 3:
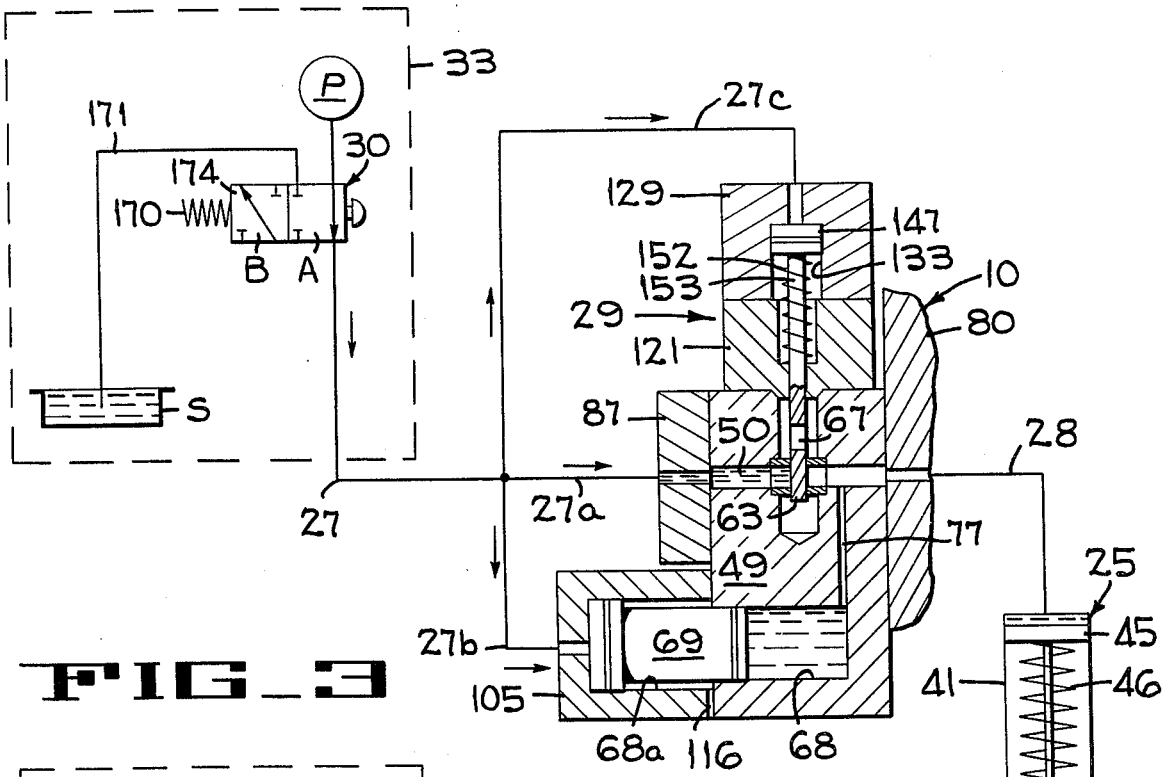
FIGS. 3–5 are circuit diagrams of one embodiment of the present invention showing a sequence of operation.
Figure 4:
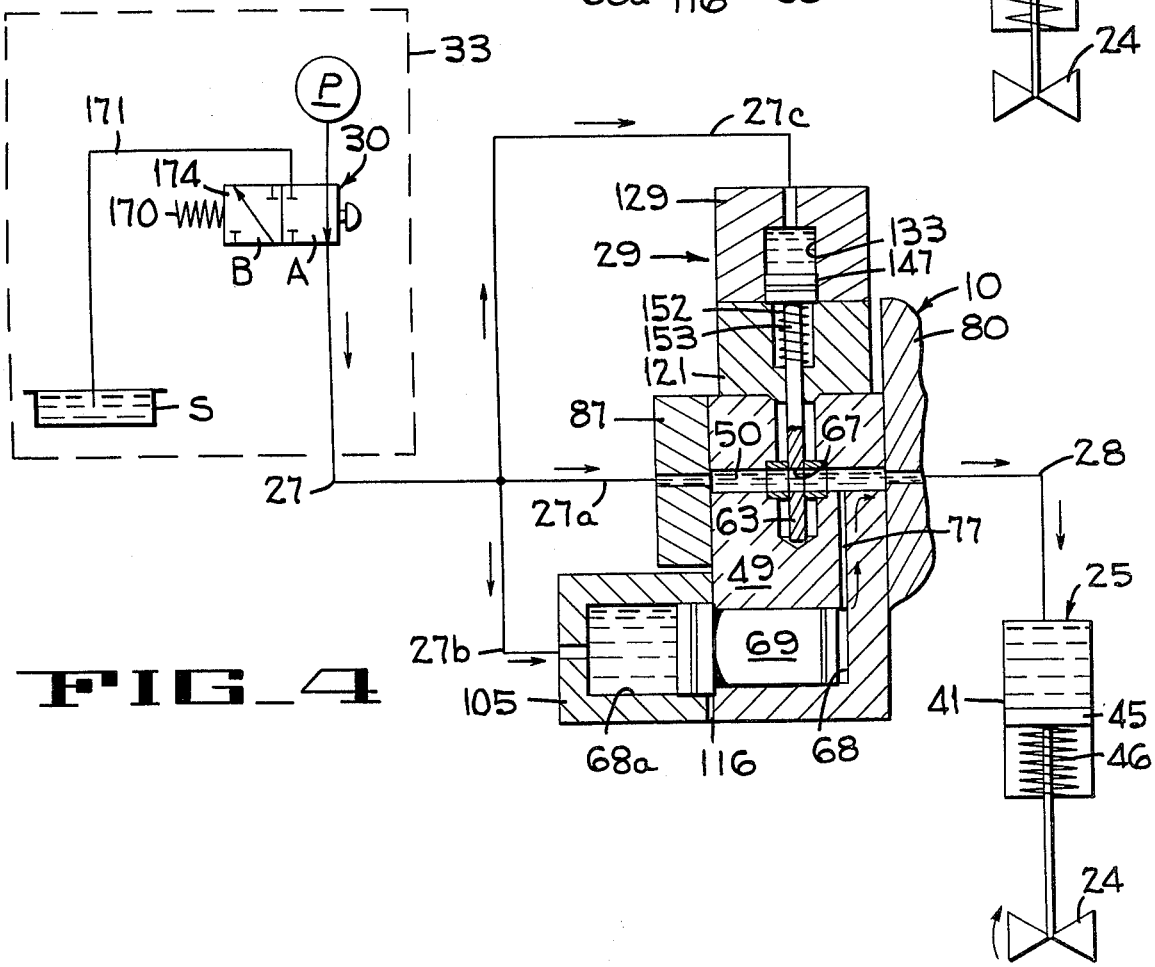
Figure 5:
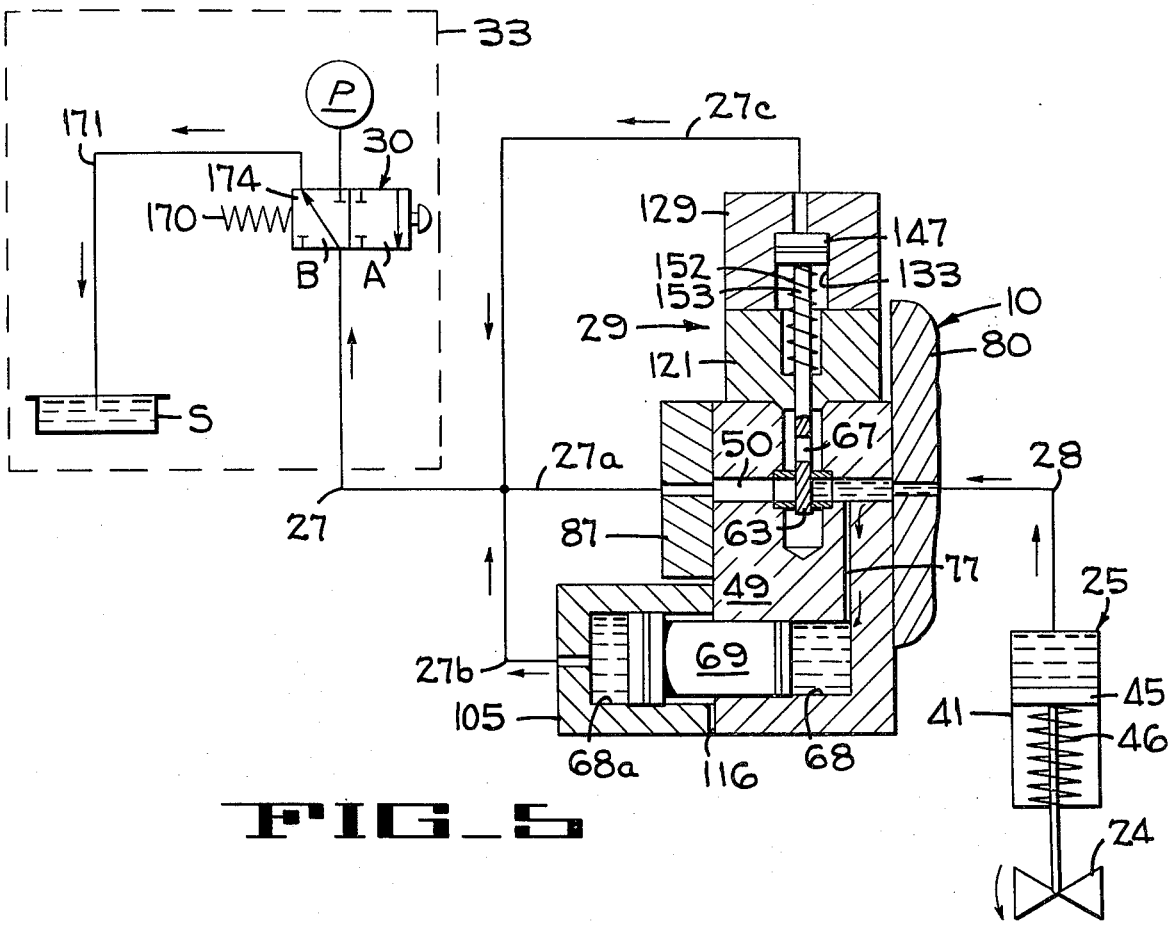

The single gate valve 29 of the present invention, shown in detail in FIG. 2, can be used to control the SCSSV when connected in the hydraulic circuit shown in FIGS. 3–5. The gate valve 29 includes a base 49, a fluid flow passage 50 extending transversely through the base, a gate chamber 51 extending through a portion of the base and intersecting the passage 50, and a pair of enlarged flow passage portions **50*a*,50*b* adjacent the chamber 51. Fitted into each of the enlarged passage portions 50*a*,50*b* is a tubular insert 55,56, respectively, each insert having an external annular groove 57 in its outer wall 61,62, and an annular sealing member 62 positioned in the groove to provide a fluid-tight seal between the insert and the enlarged portion of the passage. Each of the inserts extends into the gate chamber 51 where it makes sliding contact with a flat valve gate 63 having a throughport 67. When the valve 63 is in the deenergized position shown in FIG. 2 the flow of fluid between the right and left portions of the passage 50** is blocked.

The lower portion of the base includes a fluid accumulator AC1 (FIG. 2) comprising a chamber 68 and a fluid-actuated piston 69. The chamber 68 includes an enlarged portion **68*a*, and the piston includes a radially outward extending flange 69*a*. An annular sealing member 73, located in an annular groove 74 in the piston flange 69*a*, provides a fluid-tight seal between the flange 69*a* and the walls of the enlarged chamber 68*a*, and an annular sealing member 75, located in an annular groove 76 in the body of the piston 69, provides a fluid-tight seal between the piston body and the wall of the chamber 68. A fluid passageway 50 interconnects the chamber 68 and the flow passage 50**.

The base 49 of the gate valve can be fastened to a christmas tree adaptor 80 (FIGS. 1–2) by capscrews (not shown) or other suitable means, in which case an annular seal 81 in grooves 85,86 provides a fluid-tight barrier between the base and the tree adaptor. Alternately, the base 49 may be formed as part of the wall of the christmas tree adaptor, or the entire valve can be machined into a portion of the tree adaptor.

A cover plate 87 (FIG. 2) is secured to the valve base 49 by a plurality of studs 91, each of which projects through a hole 92 in the cover plate 87 and into a threaded bore 93 in the base 49, and a like plurality of nuts 97 threaded into the outer ends of the studs 91. A control function line 27*a* is connected to the outer end of a threaded bore 50*c* in the cover plate, and an annular metal seal 99 surrounding the flow passage 50 in annular grooves 103,104, provides a fluid-tight barrier between the cover plate 87 and the base 49.

An accumulator actuator housing 105 is secured to the base 49 (FIG. 2) by a plurality of studs 109 and nuts 115 (only one of each being shown), each stud projecting through a hole 110 in the actuator and into a threaded bore 111 in the base 49. A passage 116, extending between the accumulator chamber's enlarged portion 68*a* and the outside of the actuator housing 105, vents the chamber 68*a* to the outside of the gate valve 29, and hydraulic line 27*b* is threaded into a bore 117 which extends into the enlarged chamber 68*a*. Because the surface area 69*b* of the piston's flange 69*a* is greater than the surface area 69*c* of the piston's other end, the piston will move in the direction of the arrow X when fluid pressures are substantially equal in the chamber 68 and the hydraulic line 27*b*.

A gate valve actuator base 121 (FIG. 2) is attached to the valve base 49 by a plurality of capscrews 122 (only one being shown) threaded into bores 123 in the base 49. The actuator base 121 includes a longitudinal bore 127 having a lower portion 127*a* and an enlarged upper portion 127*b*.

An elongated actuator cap 129 (FIG. 2) is secured to the actuator base 121 by a plurality of capscrews 134 (only one shown) each extending through a hole 135 into threaded engagement with a bore 139 in the base 121. The cap 129 has a central bore 133 with a first section 133*a*, a second section 133*b* with a reduced diameter, and a third section 133*c* of further reduced diameter. The outer end of the bore 133 is closed and sealed from the atmosphere by means of a capscrew 146 threaded into the bore section 133*c*, and an elongated plug 140, with an annular sealing element 141 in an annular groove 145, is positioned in the bore section 133*b*. In the bore section 133*a* is a piston 147 that is connected to the valve gate 63 by a rod 153, and this piston is biased toward the plug 140 by a coil spring 152. The rod 153 extends through an annular packing spacer 157 that is sealed to the actuator bore 127*b* and the actuator cap 129 by annular seal elements 158,159, respectively, and an annular packing 163 provides a dynamic seal between the base 121 and the rod 153.

The actuator cap 129 includes another axial bore 164 with its inner end communicating with the bore section 133*a* and its outer threaded end 164*a* connected to a hydraulic control line 27*c*. A radially extending bore 165, having a threaded outer portion 165*a*, extends into the bore section 133*a* to provide space for air when the piston 147 moves toward the actuator base 121. A plug 169 in the threaded portion of the bore 165 is removed in order to vent the bore 133*a* to the outside during normal operations.

The gate valve 29 is connected to the surface control center 33 by the single control line 27 (FIGS. 3–5) to provide operation of this valve and the SCSSV 24. The three-way valve 30 at the control center is biased toward the right by a spring 170 to connect the B-section between the hydraulic line 27 and a hydraulic line 171 as shown in FIG. 5. In the "B-position" of the valve 30 (FIG. 5) the hydraulic lines 27*a*–27*c* are each connected to the sink S by the line 171 and valve 30 allowing the safety valve actuator 25 to close the SCSSV 24.

To open the SCSSV a spool 174 of the three-way valve is moved to the left until the A-section (FIG. 3) of the valve connects the pressure source P to the hydraulic control lines 27, 27*a*–27*c*. Pressure on the control line 27*b* moves the accumulator actuator piston 69 to the right forcing fluid from the accumulator chamber 68 through the passage 77, valve outlet port 50*d* and input hydraulic line 28 into the SCSSV actuator 25 and moving the piston to the right end of the chamber 68 as seen in FIG. 4. Pressure on the control line 27*c* moves the valve actuator piston 147 downward until the valve gate port 67 (FIG. 4) is aligned with the fluid flow passage 50 and fluid moves from passage 50 into the SCSSV actuator 25 forcing the piston 45 downward against the spring 46 and opening the SCSSV 24.

To close the SCSSV the spool 174 of the three-way valve is released and the valve moved back to the "B-position" by the spring 170 thereby connecting the control line 27 to the sink S and relieving the pressure on line 27. The actuator piston 147 (FIGS. 2–5) is moved upward (FIG. 5) and the valve gate 63 blocks the fluid flow passage 50 in the gate valve 29. The SCSSV actuator spring 46 forces the piston 45 upward (FIG. 5) moving the fluid out of the actuator body 41, through the hydraulic line 28 and passage 77 into the accumulator chamber 68 and moving the accumulator piston 69 to the left. As the piston 45 in the SCSSV actuator 25 moves upward the SCSSV 24 closes.

It is believed that the hereinbefore described safety valve manifold system will insure proper operation of a SCSSV while providing isolation of the SCSSV from the environment outside an oil or gas well. Only one hydraulic control line is required to operate the SCSSV and the shut-off valve. The system is very simple and requires few components.

Although the best mode contemplated for carrying out the present invention has been herein shown and described, it will be apparent that modification and variation may be made without departing from what is regarded to be the subject matter of the invention.

What is claimed is:

1. A hydraulic valve operating system for opening and closing a surface-controlled, sub-surface safety valve, said system connected for use with a source of pressurized hydraulic fluid and a surface-controlled, sub-surface safety valve mounted in a petroleum well having a wall, said safety valve including a valve actuator having an inlet port, said well including a block valve mounted to a Christmas tree atop said well to connect the safety valve actuator to an outside hydraulic pressure source and to a pressure sink while isolating the safety valve from the outside environment by preventing fluids from being discharged to the outside environment, said system comprising:

a normally closed block valve housing an inlet port and an outlet port;

a fluid accumulator having a variable volume fluid chamber and an inlet port connected to said fluid chamber;

means for decreasing the volume of said accumulator fluid chamber in response to an increase in hydraulic fluid pressure;

means for connecting said block valve outlet port and said accumulator inlet port to said safety valve actuator inlet port while preventing fluid flow to the outside environment;

means for selectively connecting said block valve inlet port and said accumulator volume varying means to said hydraulic pressure source;

means for opening said block valve when said block valve inlet port is connected to said hydraulic pressure source; and means for selectively connecting said block valve inlet port and said accumulator volume varying means to said pressure sink.

2. A valve operating system as defined in claim 1 including a control valve, and means for connecting said control valve between said pressurized source, and said block valve inlet port and said accumulator volume varying means.

3. A valve operating system as defined in claim 1 including a two-position control valve, said control valve connecting said block valve inlet port to said sink when said control valve is in a first position and said control valve connecting said block valve inlet port to said hydraulic pressure source when said control valve is in a second position.

4. A valve operating system as defined in claim 3 including means for biasing said control valve toward said first position.

5. A hydraulic valve operating system for opening and closing a surface-controlled, sub-surface safety valve, said system connected for use with a source of pressurized hydraulic fluid and a surface-controlled, sub-surface safety valve mounted in a petroleum well having a wall, said safety valve including a valve actuator having an inlet port, said well including a block valve mounted to a Christmas tree atop said well to connect the safety valve actuator to an outside hydraulic pressure source and to a pressure sink while isolating the safety valve from the outside environment by preventing fluids from being discharged to the outside environment, said system comprising:

a normally closed block valve having an inlet port and an outlet port;

a fluid accumulator having a variable volume fluid chamber and an inlet port connected to said fluid chamber;

an accumulator actuator for decreasing the volume of said accumulator chamber in response to pressure applied to an accumulator actuator inlet port;

means for connecting said block valve outlet port and said fluid accumulator inlet port to said safety valve actuator inlet port while preventing fluid flow to the outside environment;

means for selectively connecting said block valve inlet port and said accumulator actuator inlet port to said hydraulic pressure source;

means for opening said block valve when said block valve inlet port is connected to said hydraulic pressure source; and means for selectively connecting said block valve inlet port and said accumulator actuator inlet port to said pressure sink.

6. A valve operating system as defined in claim 5 wherein said means for opening said block valve include a hydraulically operated valve actuator coupled to said block valve and means for connecting said hydraulically operated actuator to said inlet port of said block valve inlet port.

7. A valve operating system as defined in claim 5 including a control valve connected between said hydraulic pressure source and said inlet ports of said block valve and said accumulator actuator.

8. A valve operating system as defined in claim 5 wherein said accumulator actuator includes a piston movably mounted in said accumulator fluid chamber and wherein a fluid pressure applied to said accumulator actuator inlet port moves said actuator piston toward said accumulator inlet port to decrease the volume of the fluid chamber between said piston and said accumulator inlet port.

9. A valve operating system as defined in claim 5 including a two-position control valve; means for connecting said control valve to said pressure sink, to said pressure source and to said inlet port of said block valve, said control valve coupling said pressure sink to said inlet port of said block valve when said control valve is in a first position, said control valve coupling said pressure source to said inlet port of said block valve when said control valve is in a second position.

10. A valve operating system as defined in claim 9 including means for biasing said two-position control valve toward said first position.

11. A valve operating system as defined in claim 9 wherein said control valve is mounted so as to be accessible for surface control.

12. A valve operating system as defined in claim 1 wherein said fluid accumulator includes a fluid chamber having a movable piston mounted between an actuator port and said inlet port, and means for connecting said actuator port to said hydraulic pressure source to decrease the volume of said accumulator by moving said piston in response to a pressure at said actuator port.

13. A valve operating system as defined in claim 5 wherein said fluid accumulator includes a movable piston mounted in said fluid chamber and means for connecting said accumulator actuator to said piston to decrease the volume of said accumulator by moving said piston in response to a pressure at said actuator inlet port.

14. A hydraulic valve operating system for opening and closing a surface-controlled, sub-surface safety valve, said system connected for use with a source of pressurized hydraulic fluid and a surface-controlled, sub-surface safety valve mounted in a petroleum well having a wall, said safety valve including a valve actuator having an inlet port, said well including a block valve mounted to a Christmas tree atop said well to connect the safety valve actuator to an outside hydraulic pressure source and to a pressure sink while isolating the safety valve from the outside environment, said system comprising:

a normally closed block valve having an inlet port and an outlet port;

a fluid accumulator having a variable volume fluid chamber and an inlet port connected to said fluid chamber, said accumulator having an accumulator piston to vary the volume of said fluid chamber;

an accumulator actuator having an inlet port and a movable piston, said actuator piston having a larger area than said accumulator piston;

means for coupling said accumulator piston to said actuator piston;

means for connecting actuator inlet port and said accumulator inlet port to said source of hydraulic fluid to reduce the volume of said accumulator when pressure on said actuator piston is equal to the pressure on said accumulator piston by causing said actuator piston to move said accumulator piston;

means for connecting said block valve outlet port and said accumulator inlet port to said safety valve actuator inlet port;

means for selectively connecting said block valve inlet port and said accumulator volume varying means to said hydraulic pressure source;

means for opening said block valve when said block valve inlet port is connected to said hydraulic pressure source; and means for selectively connecting said block valve inlet port and said accumulator volume varying means to said pressure sink.

* * * * *